US010139149B2

(12) United States Patent
Lim et al.

(10) Patent No.: US 10,139,149 B2
(45) Date of Patent: Nov. 27, 2018

(54) REFRIGERATOR AND METHOD FOR CONTROLLING THE SAME

(71) Applicant: SAMSUNG ELECTRONICS CO., LTD., Suwon-si, Gyeonggi-do (KR)

(72) Inventors: Chang Hak Lim, Hwaseong-si (KR); Kook Jeong Seo, Seoul (KR); Young Seok Kim, Suwon-si (KR); Yoon Young Kim, Suwon-si (KR); Won-Jae Yoon, Seoul (KR); Kyung Hoon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 146 days.

(21) Appl. No.: 15/201,794

(22) Filed: Jul. 5, 2016

(65) Prior Publication Data

US 2017/0003064 A1 Jan. 5, 2017

(30) Foreign Application Priority Data

Jul. 2, 2015 (KR) ..... 10-2015-0094595

(51) Int. Cl.
*F25D 11/02* (2006.01)
*F25B 5/02* (2006.01)
(Continued)

(52) U.S. Cl.
CPC ..... *F25D 11/022* (2013.01); *F25B 5/02* (2013.01); *F25B 49/022* (2013.01); *F25D 21/04* (2013.01); *F25D 29/003* (2013.01); *F25B 2400/19* (2013.01); *F25B 2600/2507* (2013.01); *F25B 2700/2104* (2013.01);
(Continued)

(58) Field of Classification Search
CPC ..... F25D 11/022; F25D 21/04; F25D 29/003; F25D 2700/121; F25D 2600/06
See application file for complete search history.

(56) References Cited

U.S. PATENT DOCUMENTS 6,397,608 B1 * 6/2002 Sakuma ..... F25B 5/02 62/158
2010/0131107 A1 * 5/2010 Eom ..... F25D 17/065 700/275

FOREIGN PATENT DOCUMENTS

CN 1298083 6/2001
CN 1818521 8/2006
(Continued)

OTHER PUBLICATIONS

Kashiwa et al., Heat Pump System, Jun. 14, 1991, JPH03140766A, Whole Document.*
(Continued)

*Primary Examiner* — Larry Furdge
(74) *Attorney, Agent, or Firm* — Staas & Halsey LLP

(57) ABSTRACT

A refrigerant recovery operation method for use in a refrigerator in which a freezing chamber and a refrigerating chamber are independently cooled is disclosed. The refrigerator and the method for controlling the same provide for performing the refrigerant recovery operation not only when the compressor starts operation but also before the compressor stops operation. The refrigerator increases the refrigerant recovery amount within a predetermined pressure range in which the compressor can operate, and controls the refrigerant recovery operation time according to the outdoor air temperature.

14 Claims, 11 Drawing Sheets

(51) Int. Cl.

| | |
|---|---|
| ***F25B 49/02*** | (2006.01) |
| ***F25D 21/04*** | (2006.01) |
| ***F25D 29/00*** | (2006.01) |

(52) U.S. Cl.

CPC ..... *F25B 2700/2106* (2013.01); *F25D 2400/361* (2013.01); *F25D 2600/02* (2013.01); *F25D 2600/06* (2013.01); *F25D 2700/121* (2013.01); *F25D 2700/14* (2013.01)

(56) References Cited

FOREIGN PATENT DOCUMENTS

| | | | | |
|---|---|---|---|---|
| CN | 1840987 | | | 10/2006 |
| CN | 102102933 | | | 6/2011 |
| EP | 0 583 905 | A1 | | 2/1994 |
| EP | 1 106 943 | A2 | | 6/2001 |
| EP | 1 106 943 | A3 | | 8/2001 |
| EP | 1 707 901 | A2 | | 10/2006 |
| EP | 2 339 274 | A2 | | 6/2011 |
| EP | 2 339 274 | A3 | | 1/2014 |
| JP | H03140766 | A | * | 6/1991 |
| JP | 2002-71254 | | | 3/2002 |
| JP | 2002-277083 | | | 9/2002 |
| JP | 2011-174662 | | | 9/2011 |
| KR | 10-2008-0103857 | | | 11/2008 |
| WO | WO 2008/120864 | A1 | | 10/2008 |
| WO | WO 2008/120865 | A1 | | 10/2008 |

OTHER PUBLICATIONS

Extended European Search Report dated Nov. 2, 2016, in corresponding European Patent Application No. 16177247.0.

Chinese Office Action dated May 21, 2018 in Chinese Patent Application No. 201610515584.5.

European Communication under Rule 71(3) dated Jun. 29, 2018 in European Patent Application No. 16177247.0.

* cited by examiner

REFRIGERATOR AND METHOD FOR CONTROLLING THE SAME

CROSS-REFERENCE TO RELATED APPLICATIONS

This application claims the benefit of Korean Patent Application No. 10-2015-0094595, filed on Jul. 2, 2015 in the Korean Intellectual Property Office, the disclosure of which is incorporated herein by reference.

BACKGROUND

1. Field

Embodiments of the present disclosure relate to a refrigerant recovery operation method for use in a refrigerator in which a freezing chamber and a refrigerating chamber are independently cooled.

2. Description of the Related Art

Generally, refrigerators are apparatuses to which a general refrigerating cycle to circulate a refrigerant thereinto is applied so as to supply cold air, generated by absorbing surrounding heat when the refrigerant in a liquid state is evaporated, to storage chambers, such as freezing and refrigerating chambers, to store food in a fresh state for a long time. The freezing chamber is kept at a low temperature of about −20° C., and the refrigerating chamber is kept at a low temperature of about 3° C.

Among these refrigerators, a parallel cycle-type refrigerator in which an evaporator is separately installed in each of a freezing chamber and a refrigerating chamber and operations of the freezing chamber and the refrigerating chamber are independently controlled using a 3-way valve has been disclosed.

The parallel cycle-type refrigerator achieves the operation of the refrigerating chamber independently of the operation of the freezing chamber and thus maintains high evaporation temperature of the refrigerating chamber, thereby improving energy efficiency during the operation of the refrigerating chamber. However, in the parallel cycle-type refrigerator, a certain amount of refrigerant moves to the freezing chamber evaporator and is trapped in the freezing chamber evaporator, and thereby the refrigerant becomes insufficient during the next operation of the refrigerating chamber.

Therefore, in the conventional parallel cycle-type refrigerator, after the operations of the refrigerating chamber and the freezing chamber, a refrigerant recovery operation (a pump down operation), in which the refrigerant distributed at a low-pressure part (the freezing chamber evaporator and the refrigerating chamber evaporator) is transferred to a high-pressure part (a condenser) by operating the compressor under the condition that passages of the 3-way valve in two directions, i.e., passages of the 3-way valves at the sides of the refrigerating chamber and the freezing chamber are closed, is performed, and then the operation of the compressor is completed.

Conventionally, the refrigerant recovery operation is performed only once when the compressor starts operation or just before the compressor stops operation. Therefore, the time for the refrigerant recovery operation must be sufficiently guaranteed so as to recover refrigerant kept at a low-pressure part. However, since suction pressure of the compressor is reduced in proportion to the increasing refrigerant recovery operation time, energy needed to drive the compressor increases and pressure of the low-pressure part (a freezing chamber evaporator and a refrigerating chamber evaporator) is rapidly reduced down to a vacuum. If a temperature of each evaporator is rapidly reduced to an extremely low temperature due to abrupt pressure reduction and refrigerant evaporation, refrigerant having an extremely low temperature is introduced into the compressor, such that the compressor temperature is reduced and liquid compression occurs, resulting in reduction of reliability of the compressor. As a result, there is a need to increase the refrigerant recovery amount within a predetermined pressure range in which the compressor can operate.

SUMMARY

Therefore, it is an aspect of the present disclosure to provide a refrigerator and a method for controlling the same in which a refrigerant recovery operation is performed not only when the compressor starts operation but also before the compressor stops operation, such that a refrigerant recovery operation time and reliability of the compressor are guaranteed.

It is another aspect of the present disclosure to provide a refrigerator and a method for controlling the same in which a refrigerant recovery operation time is variably controlled according to an outdoor air temperature, resulting in improvement of energy efficiency.

Additional aspects of the present disclosure will be set forth in part in the description which follows and, in part, will be obvious from the description, or may be learned by practice of the present disclosure.

In accordance with an aspect of the present invention, a refrigerator includes: a compressor; a condenser configured to condense refrigerant compressed by the compressor; a freezing chamber evaporator and a refrigerating chamber evaporator connected in parallel to an outlet of the condenser; a flow passage switching valve configured to switch a flow passage of the refrigerant in a manner that the refrigerant flows toward any one of the freezing chamber evaporator and the refrigerating chamber evaporator; and a controller configured to control the flow passage switching valve in a manner that a refrigerant recovery operation is performed not only when the compressor starts operation but also before the compressor stops operation.

The refrigerator may further include: a temperature sensor configured to detect an outdoor air temperature, wherein the controller variably controls a refrigerant recovery operation time according to the detected outdoor air temperature.

The controller may increase the refrigerant recovery operation time in proportion to the increasing outdoor air temperature.

The refrigerator may further include: a check valve arranged at an outlet of the freezing chamber evaporator, wherein the check valve prevents the refrigerant from flowing to the freezing chamber evaporator during the refrigerant recovery operation.

The flow passage switching valve may be a 3-way valve, which is connected to a pipe of an outlet of the condenser and also connected to pipes of inlets of the freezing chamber evaporator and the refrigerating chamber evaporator.

In accordance with another aspect of the present invention, a refrigerator includes: a first storage chamber controlled at a first target temperature; a second storage chamber spatially separated from the first storage chamber, and controlled at a second target temperature higher than the first target temperature; a first evaporator and a second evaporator respectively installed in the first storage chamber and the second storage chamber in a manner that the first storage chamber and the second storage chamber are independently cooled; a compressor connected to the first evaporator and the second evaporator so as to compress refrigerant; and a controller configured to perform a refrigerant recovery operation in which refrigerant remaining in any one of the first evaporator and the second evaporator is recovered, not only when the compressor starts operation but also before the compressor stops operation.

The refrigerator may further include: a check valve arranged at any one of outlets of the first evaporator and the second evaporator.

The refrigerator may further include: a flow passage switching valve configured to switch a flow passage of the refrigerant in a manner that the refrigerant flows toward any one of the first evaporator and the second evaporator; and wherein the refrigerant recovery operation moves the refrigerant remaining in a low-pressure part toward a high-pressure part by operating the compressor on the condition that all directions of the flow passage switching valve are closed.

In accordance with an aspect of the present invention, a method for controlling a refrigerator which includes a compressor and a freezing chamber evaporator and a refrigerating chamber evaporator connected in parallel to an outlet of the compressor includes: determining whether a start time of the compressor is achieved; if the start time of the compressor is achieved, performing a first refrigerant recovery operation in which refrigerant remaining in the freezing chamber evaporator is recovered; independently cooling a freezing chamber and a refrigerating chamber upon completion of the first refrigerant recovery operation; determining whether an OFF condition of the compressor is achieved while the freezing chamber and the refrigerating chamber are independently cooled; if the OFF condition of the compressor is achieved, performing a second refrigerant recovery operation in which refrigerant remaining in the freezing chamber evaporator is recovered; and stopping the compressor upon completion of the second refrigerant recovery operation.

The method may further include: detecting an outdoor air temperature; and changing an operation time of the first refrigerant recovery operation and an operation time of the second refrigerant recovery operation according to the detected outdoor air temperature.

The operation time of the first refrigerant recovery operation may be identical to the operation time of the second refrigerant recovery operation.

The operation time of the first refrigerant recovery operation may be different from the operation time of the second refrigerant recovery operation.

The first refrigerant recovery operation and the second refrigerant recovery operation may operate the compressor on the condition that supply of the refrigerant flowing to the freezing chamber evaporator and the refrigerating chamber evaporator is prevented, such that the refrigerant remaining in the freezing chamber evaporator moves to a high-pressure part.

The start time of the compressor may be identical to a time point at which the compressor starts operation when indoor air temperatures of the freezing chamber and the refrigerating chamber are higher than respective target temperatures by a predetermined temperature or higher.

The OFF condition of the compressor may indicate a time point at which the compressor stops operation after indoor air temperature of each of the freezing chamber and the refrigerating chamber reaches a target temperature.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
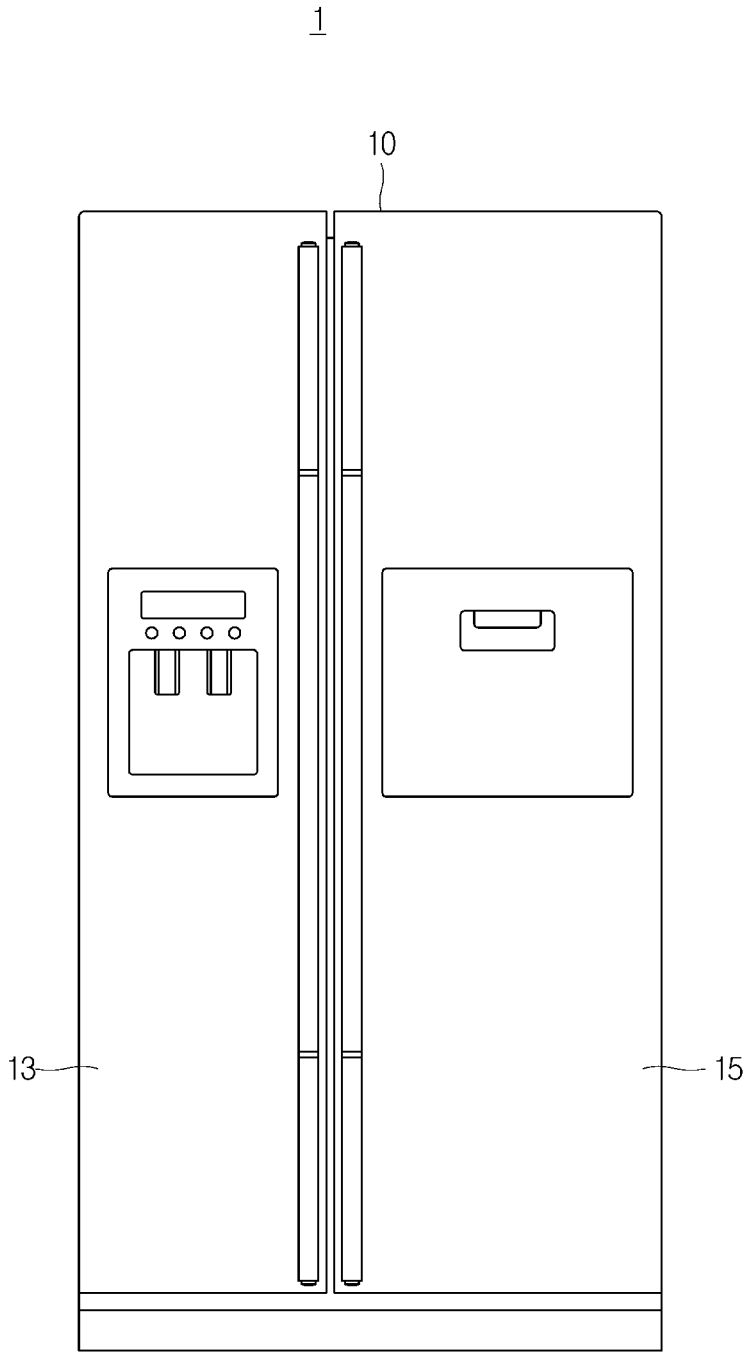
FIG. 1 is a view illustrating an external appearance of a refrigerator according to one embodiment of the present invention.

Reference will now be made in detail to the embodiments of the present disclosure, examples of which are illustrated in the accompanying drawings, wherein like reference numerals refer to like elements throughout.

Refrigerators may be broadly classified into a side-by-side type refrigerator, a bottom freezer type refrigerator, and a top mount type refrigerator. In the side-by-side type refrigerator, the freezing chamber and the refrigerating chamber are arranged side by side. In the bottom freezer type refrigerator, the freezing chamber is arranged under the refrigerating chamber. In the top mount type refrigerator, the freezing chamber is arranged above the refrigerating chamber. Although the refrigerator according to embodiments is exemplarily implemented as the side-by-side type refrigerator for convenience of description and better understanding of the present disclosure, the scope or spirit of the present disclosure is not limited thereto, and the embodiments can also be applied to the bottom freezer type refrigerator, the top mount type refrigerator, and a combination thereof.

In addition, the embodiments of the present disclosure can also be applied not only to a refrigerator in which an ice making chamber is provided at the refrigerating chamber but also to the other refrigerator in which the ice making chamber is provided at the freezing chamber, without departing from the scope or spirit of the present disclosure.

Figure 2:
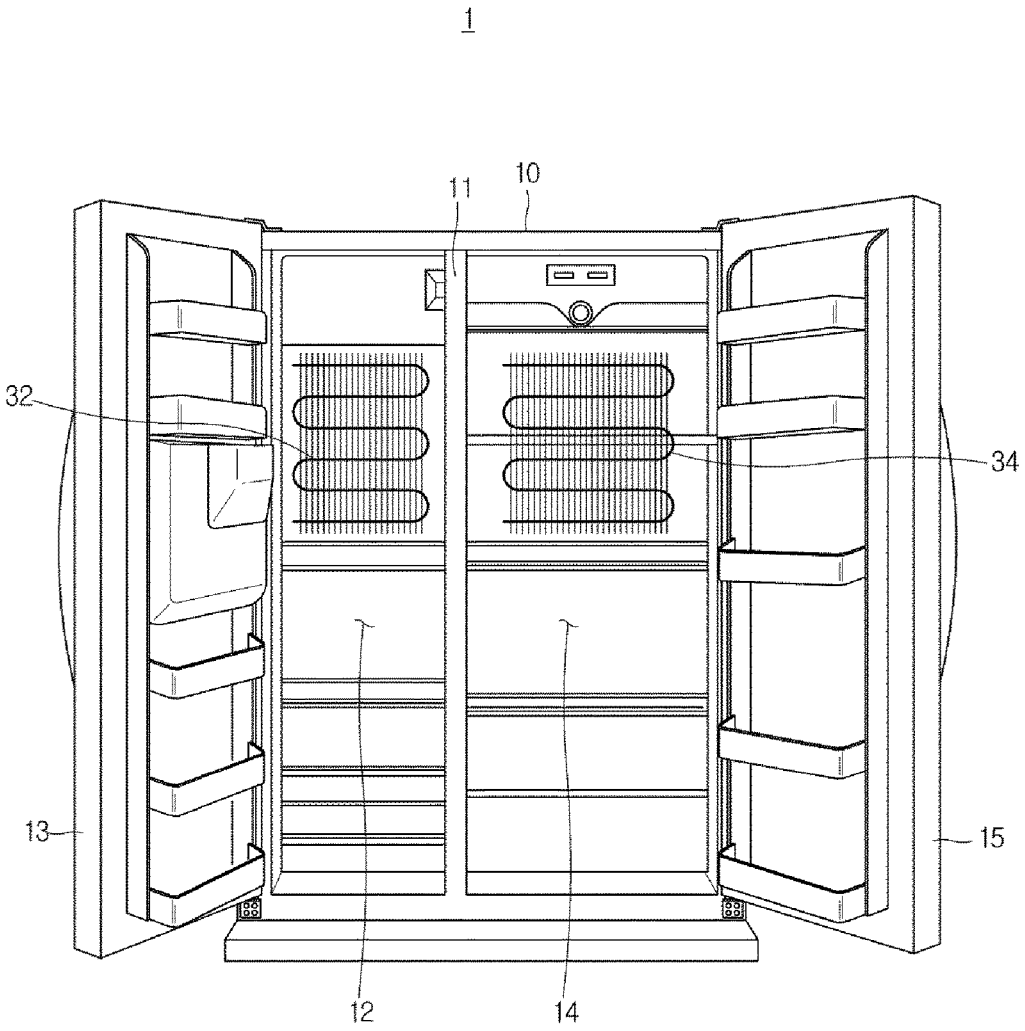
FIG. 2 is a view illustrating an internal structure of the refrigerator according to the embodiment of the present invention.

FIG. 1 is a view illustrating an external appearance of a refrigerator according to one embodiment of the present invention. FIG. 2 is a view illustrating an internal structure of the refrigerator according to the embodiment of the present invention.

Referring to FIGS. 1 and 2, the refrigerator 1 according to an embodiment may include a box-shaped main body 10 forming the external appearance thereof, a plurality of storage chambers (12, 14) formed in the main body 10 so as to store foods therein, and doors (13, 15) rotatably coupled to the main body 10 so as to open or close the plurality of storage chambers (12, 14).

The storage chambers (12, 14) are divided into a right compartment and a left compartment by a partition, such that the right compartment is used as a refrigerating chamber 14 and the left compartment is used as the freezing chamber 12. The freezing chamber 12 and the refrigerating chamber 14 are configured to form independent storage chambers, and storage temperatures of the freezing chamber 12 and the refrigerating chamber 14 may be independently controlled according to the amount of cold air supplied to the freezing chamber 12 and the refrigerating chamber 14. The freezing chamber 12 may be controlled at a first target temperature (about −20° C.), and the refrigerating chamber 14 may be controlled at a second target temperature (about +3° C.).

In addition, the freezing chamber 12 and the refrigerating chamber 14 are each divided into a plurality of spaces by a plurality of shelves, such that foods can be stored in each space. A freezing chamber evaporator 32 for cooling the freezing chamber may be installed at a back surface of the freezing chamber 12, and a refrigerating chamber evaporator 34 for cooling the refrigerating chamber 14 may be installed at a back surface of the refrigerating chamber 14.

Figure 3:
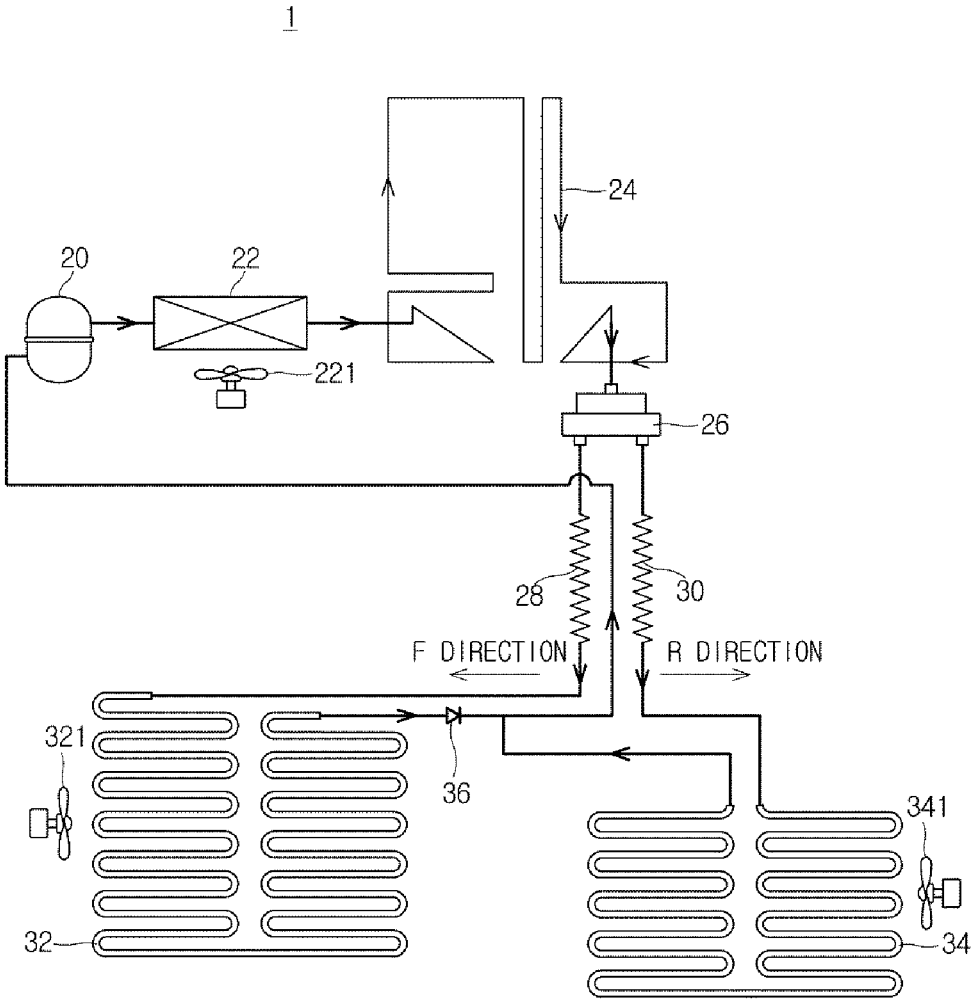
FIG. 3 is a schematic view illustrating a parallel cycle of the refrigerator according to the embodiment of the present invention.

FIG. 3 is a schematic view illustrating a parallel cycle of the refrigerator according to the embodiment of the present invention.

Referring to FIG. 3, a parallel cycle of the refrigerator 1 according to the embodiment of the present disclosure may include a compressor 20, a condenser 22, a hot pipe 24, a flow passage switching valve 26, freezing and refrigerating chamber expansion units (28, 30), freezing and refrigerating chamber evaporators (32, 34), and a check valve 36.

The compressor 20 may compress suctioned low-temperature and low-pressure gaseous refrigerant, and discharge high-temperature and high-pressure gaseous refrigerant.

For this, the compressor 20 may forcibly suction the refrigerant, and compress the suctioned refrigerant to produce high-temperature and high-pressure gas. Suctioning of the refrigerant may be carried out using rotational force of an embedded motor. By the refrigerant suctioning force of the compressor 20, the refrigerant may circulate in the cooling cycle of the refrigerator 1. Therefore, the refrigerant circulation amount and the refrigerant circulation speed may be determined according to a driving degree of the compressor 20, and the cooling efficiency of the refrigerator 1 may also be determined.

In addition, the compressor 20 may include an inlet through which refrigerant is introduced, a flow space in which introduced refrigerant flows, a motor rotating in the flow space and constituent elements associated with the motor, and an outlet through which compressed refrigerant is discharged.

Refrigerant applied to the compressor 20 may be chlorofluorocarbon (CFC) refrigerant, hydrochlorofluorocarbon (HCFC) refrigerant, hydroflurocarbon (HFC) refrigerant, or the like. However, the scope or spirit of the refrigerant according to the present disclosure is not limited thereto, and various kinds of materials capable of being selected by a system designer may also be used as the refrigerant.

The compressor 20 according to the present disclosure may be applied to an inverter compressor, a volumetric compressor, a dynamic compressor, or the like.

The high-temperature and high-pressure gaseous refrigerant compressed by the compressor 20 may be transferred to the condenser 22.

The condenser 22 may be connected to a discharge tube of a high-pressure part of the compressor 20 in a manner that high-temperature and high-pressure gaseous refrigerant compressed by the compressor 20 exchanges heat with ambient air, such that the high-temperature and high-pressure gaseous refrigerant is condensed into liquid refrigerant. In the condenser 22, the refrigerant is liquefied to emit heat to the outside, such that a temperature of the refrigerant is reduced.

The hot pipe 24 may extend from the condenser 22 and may be coupled to an inlet of the flow passage switching valve 26, and may prevent dew formation, caused by a difference in temperature between an inner space and an outer space by heat emission of the refrigerant flowing in the hot pipe 24, from occurring at the front surface of the main body 10.

The flow passage switching valve 26 may selectively switch a flow passage of the refrigerant having passed through the condenser 22 according to an operation mode (e.g., a freezing chamber operation mode or a refrigerating chamber operation mode), and may be implemented as a 3-way valve including one inlet and two outlets. The inlet may be connected to the hot pipe 24, and the two outlets may be respectively connected to a freezing chamber expansion unit 28 and a refrigerating chamber expansion unit 30, respectively. A freezing chamber side flow passage connected to the freezing chamber expansion unit 28 is hereinafter referred to as 'F' direction, and a refrigerating chamber side flow passage connected to the refrigerating chamber expansion unit 30 is hereinafter referred to as 'R' direction. The opening/closing operation of the freezing chamber side flow passage is hereinafter referred to as ON/OFF operation of the F direction, and the opening/closing operation of the refrigerating chamber side flow passage is hereinafter referred to as ON/OFF operation of the R direction.

The freezing chamber expansion unit 28 and the refrigerating chamber expansion unit 30 may expand normal-temperature and high-pressure liquid refrigerant condensed by the condenser 22 into 2-phase refrigerant in which low-temperature and low-pressure liquid and gas components are mixed. Each of the freezing chamber expansion unit 28 and the refrigerating chamber expansion unit 30 may be implemented as an expansion valve.

The expansion valve may include various kinds of valves, for example, a thermoelectric electronic expansion valve configured to use bimetal deformation, a thermostatic electronic expansion valve configured to use volumetric expansion caused by heating of inserted wax, a PWM-type electronic expansion valve configured to open or close a solenoid valve using a pulse signal, and a step-motor type electronic expansion valve configured to open or close the valve using a motor.

In addition, each of the freezing chamber expansion unit 28 and the refrigerating chamber expansion unit 30 may also be implemented as a capillary tube, instead of the expansion valve. The capillary tube may also be implemented as a slender tube, and the refrigerant passing through the capillary tube is decompressed and then applied to the freezing chamber evaporator 32 and the refrigerating chamber evaporator 34.

The freezing chamber evaporator 32 may provide cold air by evaporating low-temperature and low-pressure liquid refrigerant expanded by the freezing chamber expansion unit 28 into a gaseous state. The refrigerating chamber evaporator 34 may provide cold air by evaporating low-temperature and low-pressure liquid refrigerant expanded by the refrigerating chamber expansion unit 30 into a gaseous state. The freezing chamber evaporator 32 and the refrigerating chamber evaporator 34 may operate according to the parallel cycle scheme in which the freezing chamber 12 and the refrigerating chamber 14 are independently operated using the flow passage switching valve 26.

Pipes extending from the outlets of the freezing chamber evaporator 32 and the refrigerating chamber evaporator 34 are combined into one pipe, and the combined pipe is connected to the inlet of the compressor 20.

A check valve 36 is installed at the outlet of the freezing chamber evaporator 32, and prevents refrigerant from flowing to the freezing chamber evaporator 32 in the parallel cycle. Although the refrigerant is collected at a side of the condenser 22 by the refrigerant recovery operation, the refrigerant is re-introduced into the freezing chamber evaporator 32 prior to execution of a subsequent refrigerating chamber operation, such that the amount of necessary refrigerant is insufficient during the operation of the refrigerating chamber 14. Therefore, the check valve 36 is installed at the outlet of the freezing chamber evaporator 32, such that it can prevent the refrigerant from being re-introduced into the freezing chamber evaporator 32.

In the refrigerator 1 according to one embodiment, the compressor 20 and the condenser 22 may be installed in a machine room (not shown) located under the main body 10, the freezing chamber evaporator 32 may be installed at the rear part of the inside of the main body 10 corresponding to a back surface of the freezing chamber 12, and the refrigerating chamber evaporator 34 may be installed at the rear part of the inside of the main body 10 corresponding to a back surface of the refrigerating chamber 14, such that the freezing chamber 12 and the refrigerating chamber 14 can be independently cooled.

In the refrigerator 1 according to one embodiment, a condensing fan 221, a freezing chamber fan 321, and a refrigerating chamber fan 341 may be respectively installed in the vicinity of the condenser 22, the freezing chamber evaporator 32, and the refrigerating chamber evaporator 34.

Figure 4:
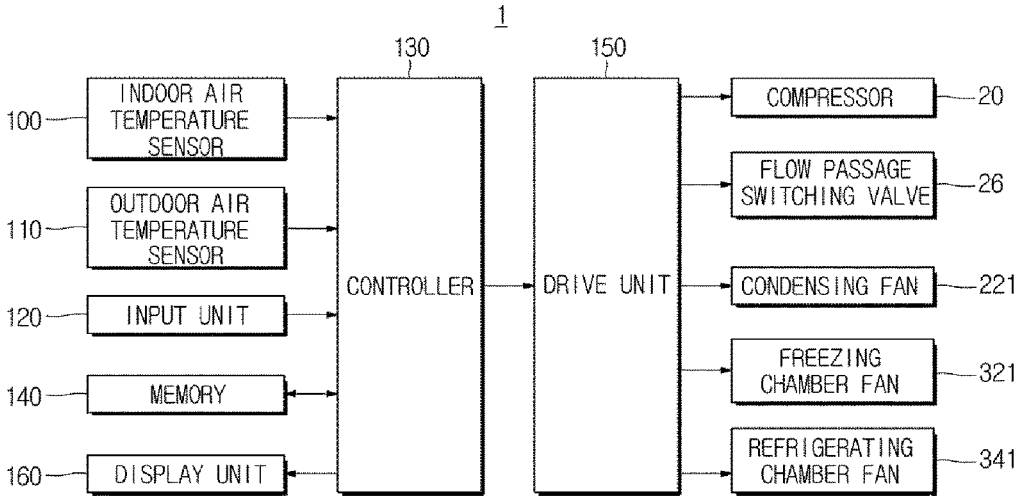
FIG. 4 is a control block diagram of the refrigerator according to the embodiment of the present invention.

FIG. 4 is a control block diagram of the refrigerator according to the embodiment of the present invention.

Referring to FIG. 4, the refrigerator 1 according to one embodiment may include the indoor air temperature sensor 100, an outdoor air temperature sensor 110, an input unit 120, a controller 130, a memory 140, a drive unit 150, and a display unit 160.

The indoor air temperature sensor 100 included in the refrigerator 1 may detect indoor air temperatures of the freezing chamber 12 and the refrigerating chamber 14, and may output the detected indoor air temperatures to the controller 130. The detected indoor air temperatures may be used as data for determining the operation conditions (a simultaneous operation or an individual operation) of the freezing chamber 12 and the refrigerating chamber 14.

In addition, the indoor air temperature sensor 100 may include at least one temperature sensor installed at arbitrary internal positions (e.g., the ceiling, bottom, or inner wall) of the freezing chamber 12 and the refrigerating chamber 14 so as to detect the indoor air temperatures of the freezing chamber 12 and the refrigerating chamber 14.

The outdoor air temperature sensor 110 may detect a temperature (i.e., outdoor air temperature) of the surrounding area of the refrigerator 1, and may transmit the detected outdoor air temperature to the controller 130.

Each of the indoor air temperature sensor 100 and the outdoor air temperature sensor 110 may be implemented as a contact temperature sensor or a non-contact temperature sensor. In more detail, the temperature sensor may be implemented as any one of a resistance temperature detector (RTD) temperature sensor configured to use the change of metal resistance depending upon temperature variation, a thermistor temperature sensor configured to use the change of semiconductor resistance depending upon temperature variation, a thermocouple temperature sensor configured to use EMF (electromotive force) generated at both ends of a junction point of two types of metal lines each formed of a different material, and an IC temperature sensor configured to use any one of a voltage generated from both ends of a transistor having characteristics changed according to temperature, and current-voltage characteristics of a PN junction unit of the transistor. However, the scope or spirit of the temperature sensor according to the embodiment is not limited thereto, and various temperature detection machines may also be used by those skilled in the art without departing from the scope or spirit of the present disclosure.

The input unit 120 may input a control command of a user to the controller 130. A plurality of buttons, for example, a mode selection button for controlling the operations of the freezing chamber 12 and the refrigerating chamber 14 and a temperature setting button for setting a temperature of each of the freezing chamber 12 and the refrigerating chamber 14 to a desired temperature, may be arranged on a control panel of the input unit 120.

In addition, the input unit 120 may be implemented not only as the above-mentioned buttons, but also as a key, a knob, a switch, a touchpad, etc. The input unit 120 may include all kinds of devices configured to generate predetermined input data by various manipulations, for example, pushing, contacting, pressing, rotating, etc.

The controller 130 may serve as a processor for controlling overall operation of the refrigerator according to operation information entered by the input unit 120, may determine the operation condition (e.g., simultaneous operation or individual operation) of the freezing chamber 12 and the refrigerating chamber 14 according to indoor air temperatures detected by the indoor air temperature sensors 100 respectively installed in the freezing chamber 12 and the refrigerating chamber 14, and may control the freezing chamber 12 and the refrigerating chamber 14 according to the parallel cycle scheme in which the freezing chamber 12 and the refrigerating chamber 14 are independently cooled.

In addition, the controller 130 may divide the refrigerant recovery operation into two sub-recovery operations, such that the two sub-recovery operations may be respectively carried out when the compressor 20 starts operation or just before the compressor 20 stops operation. Since the refrigerant recovery operation is achieved by closing all the inlets of the freezing chamber evaporator 32 and the refrigerating chamber evaporator 34, and operating the compressor 20 such that the refrigerant remaining in the low-pressure part (e.g., the freezing chamber evaporator and the refrigerating chamber evaporator) is collected into the high-pressure part (e.g., the condenser), a sufficiently long refrigerant recovery operation time needs to be guaranteed.

If the refrigerant recovery operation time is short, the amount of refrigerant recovered to the refrigerating chamber 14 becomes insufficient, such that energy consumption may increase and the cooling capacity of the refrigerating chamber 14 may decrease.

In contrast, if the refrigerant recovery operation time is long, the suction pressure of the compressor 20 needs to be excessively reduced for the remaining refrigerant recovery, and the compressor 20 operates at a low pressure, such that the compressor 20 may be damaged or broken.

Therefore, according to the parallel cycle scheme in which the refrigerating chamber 14 and the freezing chamber 12 are independently cooled, a sufficiently long refrigerant recovery operation time is guaranteed and the refrigerant recovery amount increases, such that refrigerant shortage may be prevented from occurring in the operation of the refrigerating chamber 14 and the compressor 20 may also be prevented from dropping to a low pressure, resulting in acquisition of high reliability of the compressor 20.

For this, the embodiment of the present disclosure may divide the refrigerant recovery operation into two refrigerant recovery operation actions to be respectively performed when the compressor 20 starts operation and just before the compressor 20 stops operation.

The memory 140 may store setting information (e.g., control data for controlling the refrigerator 1, reference data used in the control process of the refrigerator 1, operation data generated during a predetermined operation of the refrigerator 1, and setting data entered by the input unit 120 in a manner that the refrigerator 1 performs a given operation), use information of the refrigerator 1 (e.g., the number of specific operations executed by the refrigerator 1 and model information of the refrigerator 1), and malfunction information of the refrigerator 1 (e.g., the reason or position of a faulty operation of the refrigerator 1).

In addition, the memory 140 may store temperature control values based on the operation conditions (decided by the controller 130) of the freezing chamber 12 and the refrigerating chamber 14, and may store a control factor related to the parallel cycle operation in which the refrigerant recovery operation is carried out. For example, the memory 140 may store a detection period of the indoor air temperature sensor 100, data related to the operation time or operation RPM of the compressor 20 according to the detection result of the indoor air temperature sensor 100, a control program for controlling the refrigerator 1, and other programs (e.g., dedicated application initially supplied from the manufacturing company or universal applications downloaded from the external part).

The memory 140 may be implemented as a non-volatile memory device such as a read only memory (ROM), programmable read only memory (PROM), erasable programmable read only memory (EPROM), or flash memory, a volatile memory device such as a random access memory (RAM), or a storage unit such as a hard disk or an optical disc. However, the memory 140 is not limited thereto and may have other forms known in the art.

The drive unit 150 may drive the compressor 20, the flow passage switching valve 26, the condensing fan 221, the freezing chamber fan 321, and the refrigerating chamber fan 341, etc. associated with the operations of the refrigerator 1 according to a drive control signal of the controller 130.

The display unit 160 may display the operation state of the refrigerator 1 according to a display control signal of the controller 130, and may display a user manipulation state by recognizing the operation information entered through the input unit 120.

In addition, assuming that the display unit 160 is implemented as an LCD user interface (UI) for text display, the operation state of the refrigerator 1 is displayed as text, such that the user can conduct appropriate measures.

Assuming that the display unit 160 is implemented as an LED UI, the display unit 160 can allow the user to recognize an abnormal state of the refrigerator 1 using lighting or blinking or using a difference in duration of the display unit 160.

The operations and effects of a refrigerator and a method for controlling the same according to the embodiment of the present disclosure will hereinafter be described with reference to the attached drawings.

A method for cooling internal spaces of the freezing chamber 12 and the refrigerating chamber 14 according to the order of cooling of the refrigerating chamber 14→cooling of the freezing chamber 12→stopping of the compressor 20 in the parallel cycle of the refrigerator 1 will hereinafter be described with reference to FIGS. 5 and 6.

Figure 5:
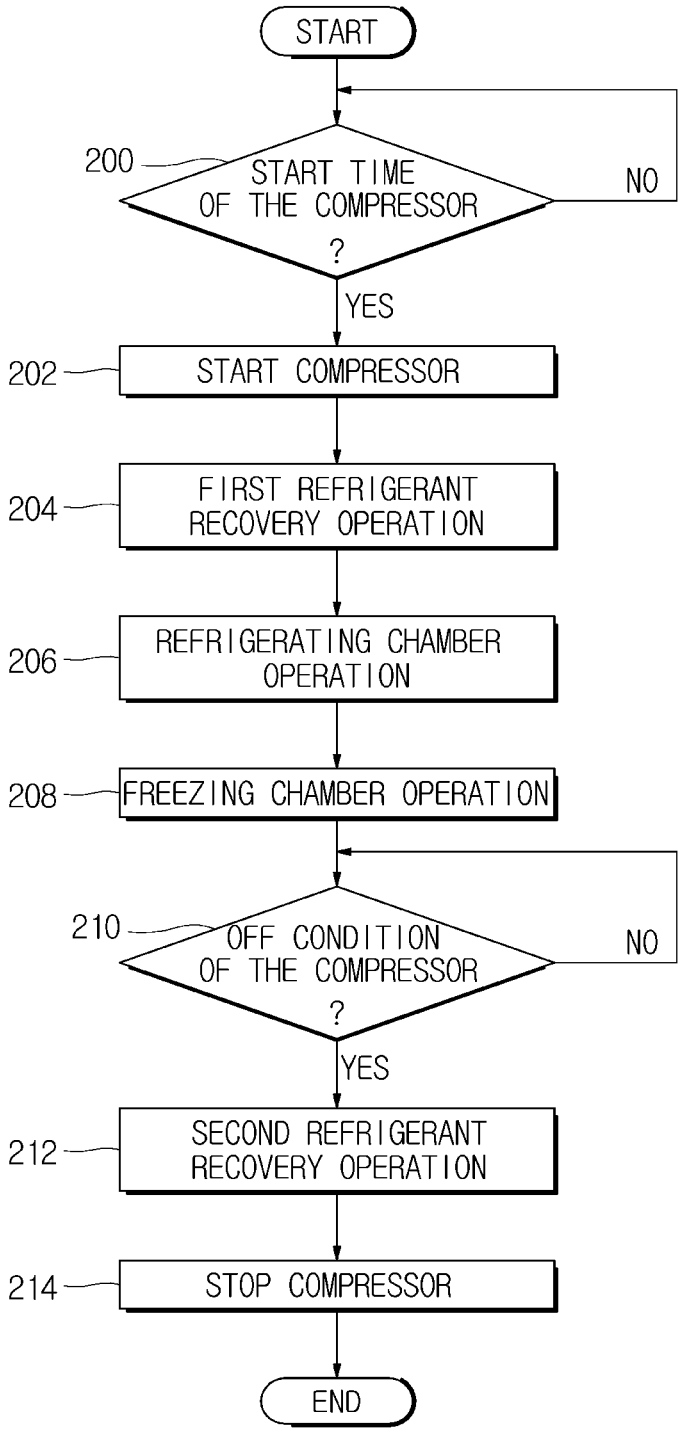
FIG. 5 is a flowchart illustrating a first control algorithm needed for a refrigerant recovery operation of the refrigerator according to an embodiment of the present disclosure.

FIG. 5 is a flowchart illustrating a first control algorithm needed for the refrigerant recovery operation of the refrigerator according to an embodiment of the present disclosure. FIG. 6 is a timing diagram illustrating refrigerant recovery control time points shown in FIG. 5.

Figure 6:
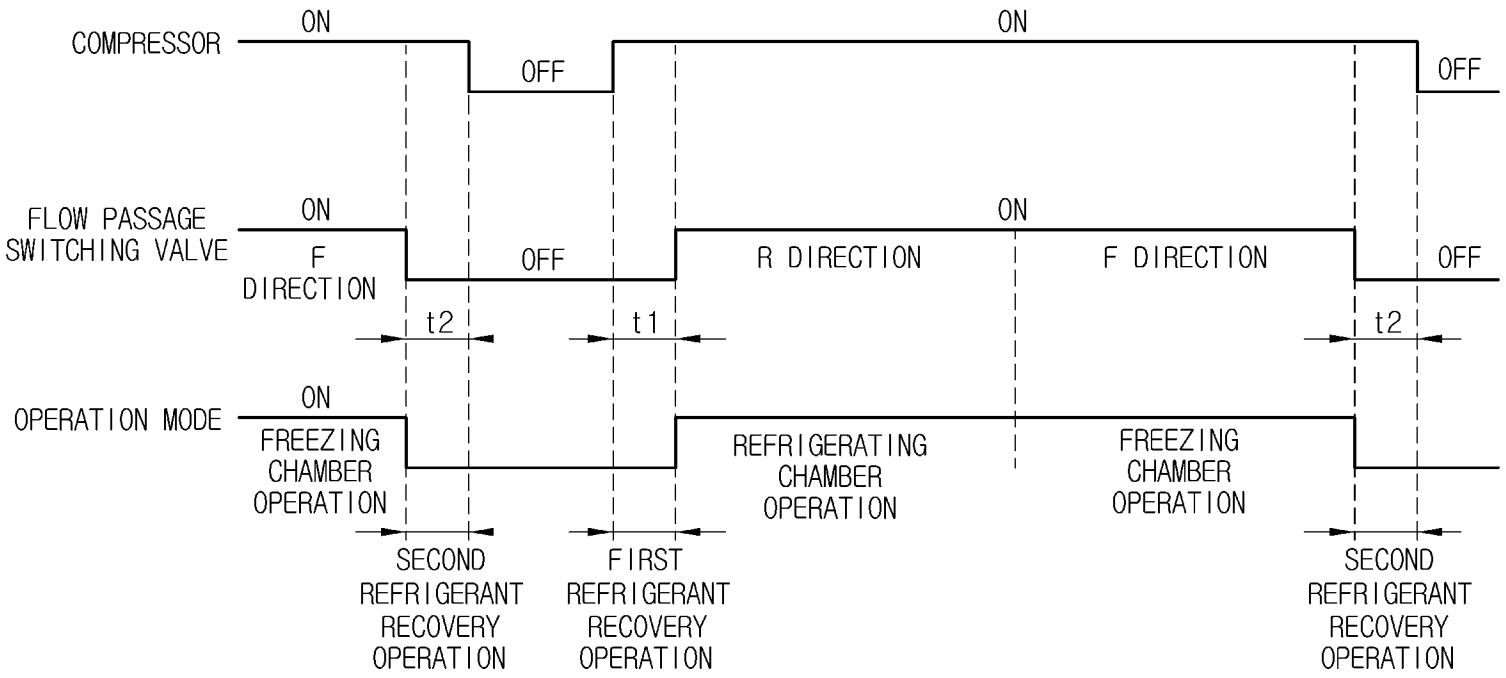
FIG. 6 is a timing diagram illustrating refrigerant recovery control time points shown in FIG. 5.

Referring to FIGS. 5 and 6, the indoor air temperature sensor 100 may detect a temperature of indoor air of each of the freezing chamber 12 and the refrigerating chamber 14, and may transmit the detected indoor air temperatures to the controller 130.

Therefore, the controller 130 may compare the indoor air temperatures (detected by the indoor air temperature sensors 100) of the freezing chamber 12 and the refrigerating chamber 14 with user setting temperatures, and may determine whether the start time of the compressor 20 is achieved (S200).

If the indoor air temperature of the freezing chamber 12 or the refrigerating chamber 14 is higher than the user setting temperature by a predetermined temperature or higher, internal load of the freezing chamber 12 or the refrigerating chamber 14 is calculated according to a difference in temperature, and the compressor 20 may then start operation at a time point corresponding to the start time of the compressor 20.

If it is determined in operation 200 that the start time of the compressor 20 is achieved, the controller 130 may output a drive control signal to the compressor 20 through the drive unit 150, such that the compressor 20 starts operation (S202).

Subsequently, the controller 130 may perform a first refrigerant recovery operation to recover the refrigerant remaining in the freezing chamber evaporator 32 into the condenser 22 at the start time of the compressor 20 (S204).

The refrigerant recovery operation starts operation of the compressor 20 under the condition that it stops providing the refrigerant to both the freezing chamber evaporator 32 and the refrigerating chamber evaporator 34 by closing both directions (F direction, R direction) of the flow passage switching valve 26, such that the refrigerant remaining in the freezing chamber evaporator 32 moves to the condenser 22. As a result, shortage of the refrigerant needed to cool the refrigerating chamber 14 in a subsequent process is prevented through the refrigerant recovery operation.

After the refrigerant remaining in the freezing chamber evaporator 32 moves to the condenser 22 through the first refrigerant recovery operation performed at the start time of the compressor 20, the controller 130 may switch on the flow passage switching valve 26 in the R direction (i.e., the refrigerating chamber direction) shown in FIG. 6 so as to cool the refrigerating chamber 14.

If the flow passage switching valve 26 is switched on in the R direction (i.e., the refrigerating chamber direction), the refrigerant may circulate in the order of compressor 20→condenser 22→hot pipe 24→flow passage switching valve 26→refrigerating chamber expansion unit 30→refrigerating chamber evaporator 34→compressor 20 in the refrigerating chamber operation mode.

Therefore, high-temperature and high-pressure gaseous refrigerant discharged from the compressor 20 is introduced into the condenser 22 so that it is condensed into high-pressure liquid refrigerant, and the high-pressure liquid refrigerant flows in the flow passage switching valve 26 after passing through the hot pipe 24.

In this case, since the flow passage switching valve 26 opens only the refrigerating chamber side flow passage in the R-direction, the refrigerant applied to the flow passage switching valve 26 is introduced into the refrigerating chamber evaporator 34 through the refrigerating chamber expansion unit 30 so as to cool the refrigerating chamber 14, and returns to the compressor 20, thereby carrying out the cooling operation of the refrigerating chamber 14 (S206).

If the refrigerating chamber 14 is cooled after the first refrigerant recovery operation is performed at the start time of the compressor 20, shortage of the refrigerant is prevented, resulting in an increase of the cooling efficiency of the refrigerating chamber 14.

After the indoor air temperature of the refrigerating chamber 14 reaches the setting temperature, the controller 130 may switch on the flow passage switching valve 26 in the F direction (i.e., the freezing chamber direction) shown in FIG. 6 so as to cool the freezing chamber 12.

If the flow passage switching valve 26 is switched on in the F direction (i.e., the freezing chamber direction), the refrigerant may circulate in the order of compressor 20→condenser 22→hot pipe 24→flow passage switching valve 26→freezing chamber expansion unit 28→freezing chamber evaporator 32→compressor 20 in the freezing chamber operation mode.

Therefore, high-temperature and high-pressure gaseous refrigerant discharged from the compressor 20 is introduced into the condenser 22 so that it is condensed into high-pressure liquid refrigerant, and the high-pressure liquid refrigerant flows in the flow passage switching valve 26 after passing through the hot pipe 24.

In this case, since the flow passage switching valve 26 opens only the freezing chamber side flow passage in the F-direction, the refrigerant applied to the flow passage switching valve 26 is introduced into the freezing chamber evaporator 32 through the freezing chamber expansion unit 28 so as to cool the freezing chamber 12, and returns to the compressor 20, thereby carrying out the cooling operation of the freezing chamber 12 (S208).

As described above, after the freezing chamber 12 and the refrigerating chamber 14 are independently cooled, the controller 130 may determine whether the compressor 20 is in an OFF condition (S210).

The OFF condition of the compressor 20 may indicate a time point at which the compressor 20 stops operation after the internal temperatures of the refrigerating chamber 14 and the freezing chamber 12 reach the respective setting temperatures.

If the compressor 20 is in the OFF condition in operation 210, the controller 130 may perform a second refrigerant recovery operation just before the compressor 20 stops operation such that the refrigerant remaining in the freezing chamber evaporator 32 is recovered into the condenser 22 (S212).

Since the second refrigerant recovery operation is carried out just before the compressor 20 stops operation, the refrigerant recovered from the freezing chamber evaporator 32 can be stored in the high-pressure part (i.e., a compressor cylinder and the condenser). The refrigerant stored in the high-pressure part is switched to the refrigerating chamber 14 along with the other refrigerant recovered by the first refrigerant recovery operation performed at the start time of the compressor 20, such that the operation efficiency of the refrigerating chamber 14 can be maximized.

As described above, the first refrigerant recovery operation and the second refrigerant recovery operation may be respectively performed when the compressor 20 starts operation and before the compressor 20 stops operation, such that the refrigerant recovery operation time can be sufficiently guaranteed and the compressor 20 is prevented from dropping to a low pressure, resulting in high reliability of the compressor 20. A detailed description thereof will hereinafter be given with reference to FIG. 7.

Figure 7:
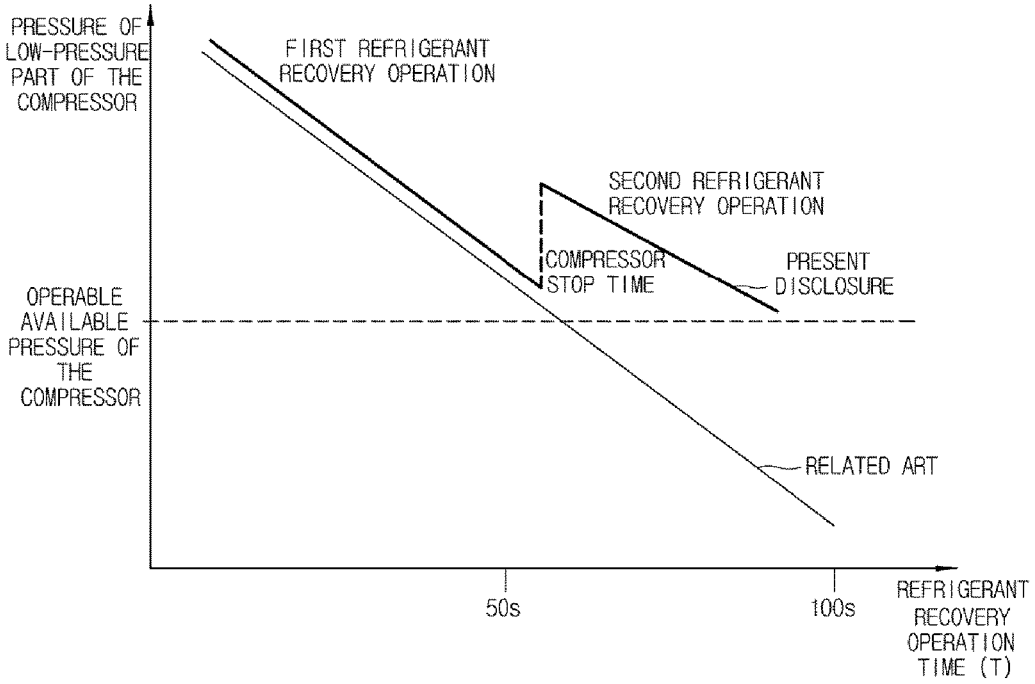
FIG. 7 is a graph illustrating a compressor pressure status changing during the refrigerant recovery operation of the refrigerator according to an embodiment of the present disclosure.

FIG. 7 is a graph illustrating a compressor pressure status changing during the refrigerant recovery operation of the refrigerator according to an embodiment of the present disclosure.

Referring to FIG. 7, according to a conventional parallel cycle, the refrigerant recovery operation is performed only once when the compressor 20 starts operation or before the compressor 20 stops operation. In order to recover the refrigerant remaining in the low-pressure part, the refrigerant recovery operation time may be carried out for about 120 seconds. If the refrigerant recovery operation time is carried out for 120 seconds, pressure of the low-pressure part of the compressor 20 is abruptly reduced so that it can be recognized that the refrigerant recovery amount is gradually reduced as shown in FIG. 7.

Therefore, according to the parallel cycle of the present disclosure, the refrigerant recovery operation is divided into two sub-recovery operations not only when the compressor 20 starts operation but also before the compressor 20 stops operation, such that the refrigerant recovery operation may be performed two times not only when the compressor 20 starts operation but also before the compressor 20 stops operation. Assuming that the refrigerant recovery operation is divided into two sub-recovery operations, pressure of the low-pressure part of the compressor 20 may increase when the compressor 20 stops operation as shown in FIG. 7. As a result, pressure reduction of the low-pressure part of the compressor 20 is decreased so that it can be recognized that the refrigerant recovery amount increases.

As described above, assuming that the refrigerant recovery operation is divided into two sub-recovery operations, instead of being performed once for a long period of time, pressure reduction of the low-pressure part of the compressor 20 is achieved within the operable available pressure of the compressor 20 as shown in FIG. 7, such that reliability of the compressor 20 can be guaranteed and the refrigerant recovery amount can increase.

Generally, although the embodiment has exemplarily disclosed that the refrigerant recovery operation time (t) may be carried out for about 120 seconds, the scope or spirit of the refrigerant recovery operation time (t) is not limited thereto, and the refrigerant recovery operation time (t) can also be changed according to the capacity or design structure of the refrigerator 1 as necessary.

After the refrigerant recovered from the freezing chamber evaporator 32 is stored in the high-pressure part through the second refrigerant recovery operation performed just before the compressor 20 stops operation, the controller 130 may stop the compressor 20 through the drive unit 150 (S214), and may then stop the parallel cycle.

Subsequently, a method for cooling internal spaces of the freezing chamber 12 and the refrigerating chamber 14 according to the order of cooling of the freezing chamber 12 cooling of the refrigerating chamber 14 stopping of the compressor 20 in the parallel cycle of the refrigerator 1 will hereinafter be described with reference to FIGS. 8 and 9.

Figure 8:
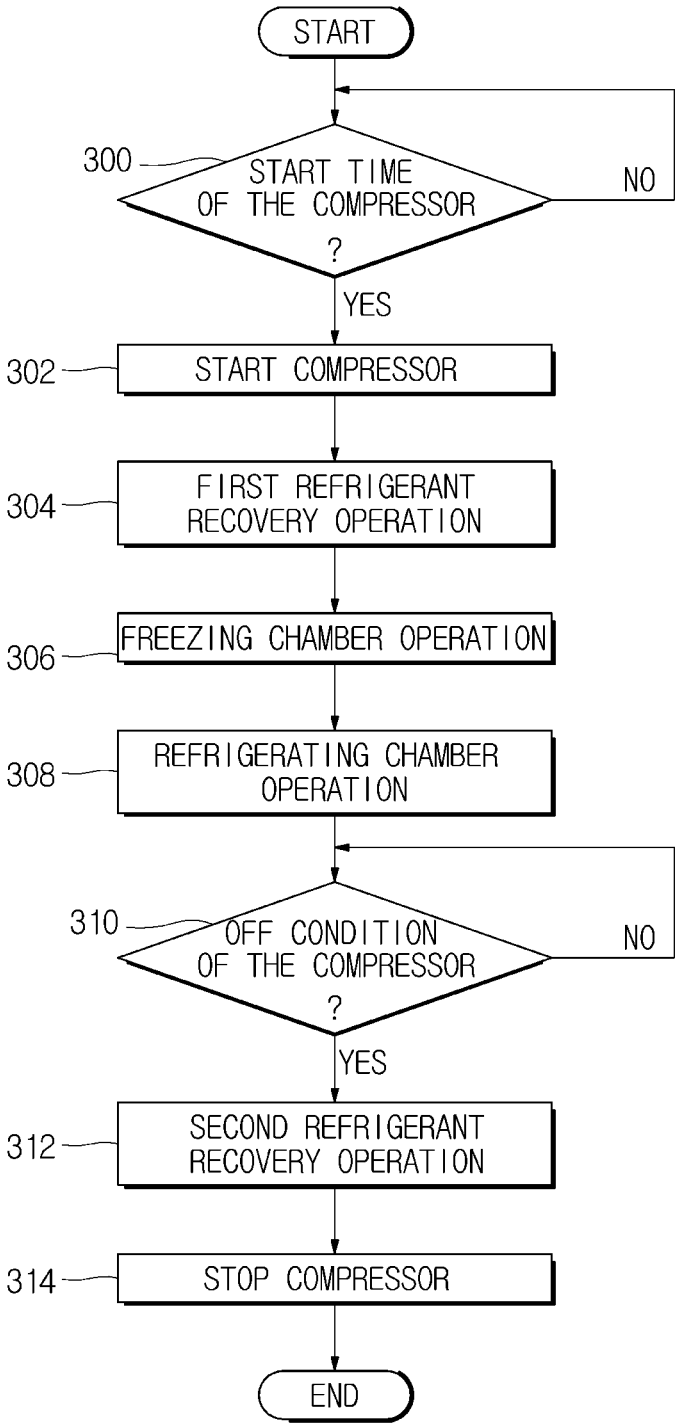
FIG. 8 is a flowchart illustrating a second control algorithm needed for a refrigerant recovery operation of the refrigerator according to an embodiment of the present disclosure.

FIG. 8 is a flowchart illustrating a second control algorithm needed for the refrigerant recovery operation of the refrigerator according to an embodiment of the present disclosure. FIG. 9 is a timing diagram illustrating refrigerant recovery control time points shown in FIG. 8. Parts of FIGS. 8 and 9 identical to those of FIGS. 5 and 6 are denoted by the same numerals and the same names, and a detailed description thereof will not be given.

Figure 9:
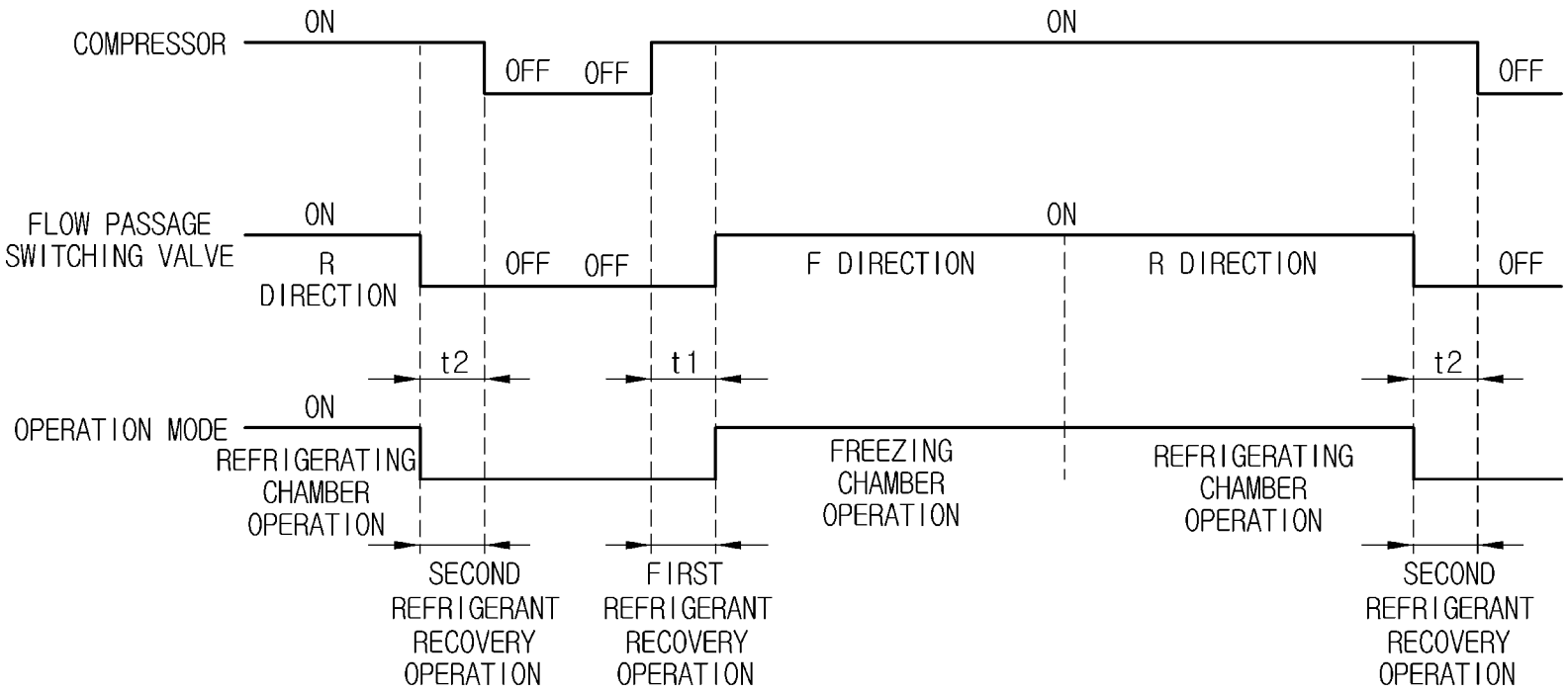
FIG. 9 is a timing diagram illustrating refrigerant recovery control time points shown in FIG. 8.

Referring to FIGS. 8 and 9, the indoor air temperature sensor 100 may detect a temperature of indoor air of each of the freezing chamber 12 and the refrigerating chamber 14, and may transmit the detected indoor air temperatures to the controller 130.

Therefore, the controller 130 may compare the indoor air temperatures (detected by the indoor air temperature sensors 100) of the freezing chamber 12 and the refrigerating chamber 14 with setting temperatures, and may determine whether the start time of the compressor 20 is achieved (S300).

If it is determined in operation 300 that the start time of the compressor 20 is achieved, the controller 130 may start operation through the drive unit 150 (S302).

Subsequently, the controller 130 may perform a first refrigerant recovery operation to recover the refrigerant remaining in the freezing chamber evaporator 32 to the side of the condenser 22 at the start time of the compressor 20 (S304).

After the refrigerant remaining in the freezing chamber evaporator 32 moves to the side of the condenser 22 through the first refrigerant recovery operation performed at the start time of the compressor 20, the controller 130 may switch on the flow passage switching valve 26 in the F direction (i.e., the freezing chamber direction) shown in FIG. 9 so as to cool the freezing chamber 12.

If the flow passage switching valve 26 is switched on in the F direction (i.e., the freezing chamber direction), the refrigerant may circulate in the order of compressor 20→condenser 22→hot pipe 24→flow passage switching valve 26→freezing chamber expansion unit 28→freezing chamber evaporator 32→compressor 20 in the freezing chamber operation mode, thereby performing the cooling operation of the freezing chamber 12 (S306).

After the indoor air temperature of the freezing chamber 12 reaches the setting temperature, the controller 130 may switch on the flow passage switching valve 26 in the R direction (i.e., the refrigerating chamber direction) shown in FIG. 9 so as to cool the refrigerating chamber 14.

If the flow passage switching valve 26 is switched on in the R direction (i.e., the refrigerating chamber direction), the refrigerant may circulate in the order of compressor 20→condenser 22→hot pipe 24→flow passage switching valve 26→refrigerating chamber expansion unit 30→refrigerating chamber evaporator 34→compressor 20 in the refrigerating chamber operation mode, thereby performing the cooling operation of the refrigerating chamber 14 (S308).

If the refrigerating chamber 14 is cooled after the first refrigerant recovery operation is performed at the start time of the compressor 20, shortage of the refrigerant is prevented, resulting in an increase of the cooling efficiency of the refrigerating chamber 14.

As described above, after the freezing chamber 12 and the refrigerating chamber 14 are independently cooled, the controller 130 may determine whether the compressor 20 is in an OFF condition (S310).

If it is determined in operation 310 that the compressor 20 is in the OFF condition, the controller 130 may perform a second refrigerant recovery operation just before the compressor 20 stops operation such that the refrigerant remaining in the freezing chamber evaporator 32 is recovered into the condenser 22 (S312).

After the refrigerant recovered from the freezing chamber evaporator 32 is stored in the high-pressure part through the second refrigerant recovery operation re-performed just before the compressor 20 stops operation, the controller 130 stops the compressor 20 through the drive unit 150 (S314), and finishes the parallel cycle.

A method for variably controlling the refrigerant recovery operation time according to outdoor air temperature will hereinafter be described with reference to FIGS. 10A and 10B.

Figure 10A:
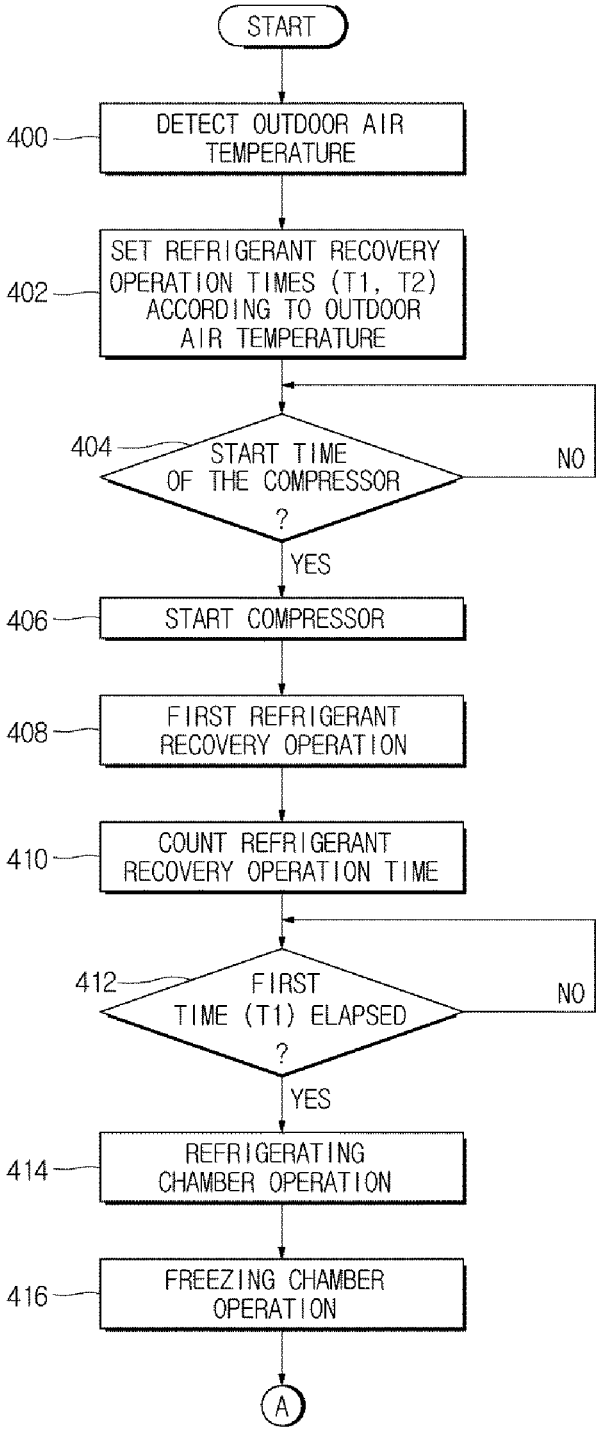
FIGS. 10A and 10B are flowcharts illustrating a control algorithm for allowing the refrigerator to change the refrigerant recovery operation time according to an outdoor air temperature according to an embodiment of the present disclosure.
Figure 10B:
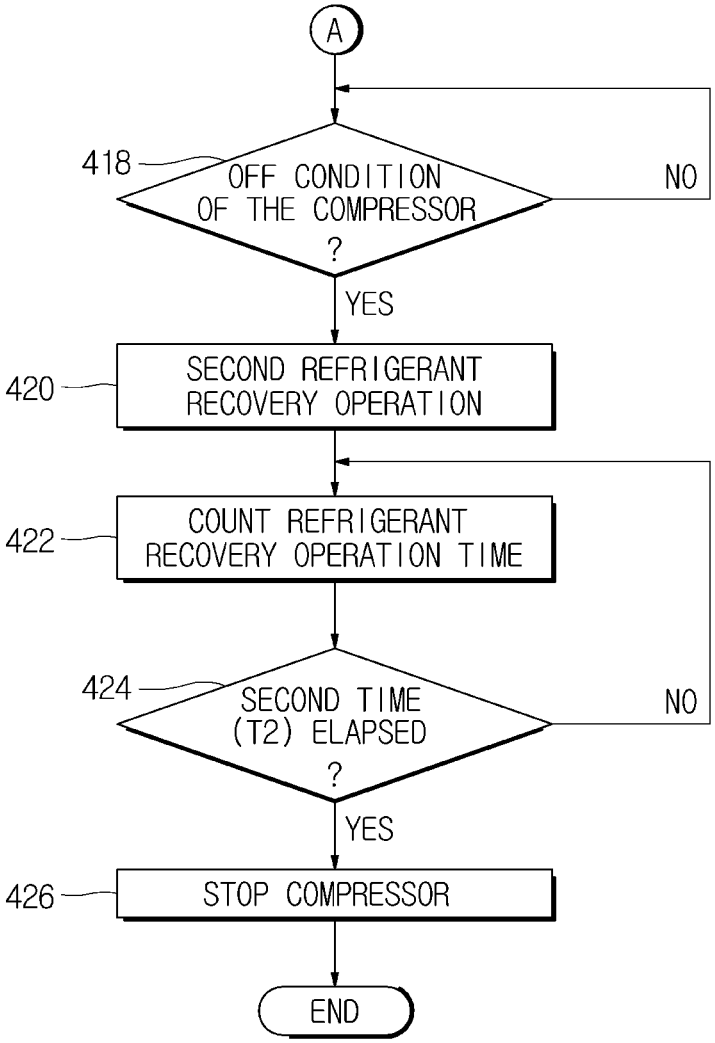

FIGS. 10A and 10B are flowcharts illustrating a control algorithm for allowing the refrigerator to change the refrigerant recovery operation time according to an outdoor air temperature according to an embodiment of the present disclosure. Parts of FIGS. 10A and 10B identical to those of FIGS. 5 and 6 are denoted by the same numerals and the same names, and a detailed description thereof will not be given.

Referring to FIGS. 10A and 10B, the outdoor air temperature sensor 110 may detect outdoor air temperature of the surrounding area of the refrigerator 1, and may transmit the detected outdoor air temperature to the controller 130 (S400).

Therefore, the controller 130 may establish the refrigerant recovery operation times (t1, t2) for carrying out refrigerant recovery operations, respectively, according to the outdoor air temperature detected by the outdoor air temperature sensor 110 (S402).

The refrigerant recovery operation times (t1, t2) may be variably controlled according to different outdoor air temperatures.

For example, if the outdoor air temperature is in a range of 29~39° C., each of the refrigerant recovery operation times (t1, t2) respectively performed when the compressor 20 starts operation and before the compressor 20 stops operation may be set to 50 seconds.

If the outdoor air temperature is in a range of 22~28° C., each of the refrigerant recovery operation times (t1, t2) respectively performed when the compressor 20 starts operation and before the compressor 20 stops operation may be set to 40 seconds.

If the outdoor air temperature is in a range of 22~28° C., the refrigerant recovery operation time (t1) performed when the compressor 20 starts operation may be set to 40 seconds, and the refrigerant recovery operation time (t2) performed before the compressor 20 stops operation may be set to 50 seconds.

If the outdoor air temperature is in a range of 8~21° C., each of the refrigerant recovery operation times (t1, t2) respectively performed when the compressor 20 starts operation and before the compressor 20 stops operation may be set to 30 seconds.

If the outdoor air temperature is in a range of 8~21° C., the refrigerant recovery operation times (t1) performed when the compressor 20 starts operation may be set to 30 seconds, and the refrigerant recovery operation time (t2) performed before the compressor 20 stops operation may be set to 50 seconds.

In other words, each of the refrigerant recovery operation times (t1, t2) may be increased in proportion to the increasing outdoor air temperature. Since thermal load based on a difference between outdoor air temperature and indoor air temperature is increased in proportion to the increasing outdoor air temperature, heat exchange amount in the refrigerating chamber evaporator 34 is increased, such that a large amount of refrigerant is needed. Therefore, each of the refrigerant recovery operation times (t1, t2) is increased in proportion to the increasing outdoor air temperature, such that the refrigerant recovery amount increases.

As described above, the refrigerant recovery operation times (t1, t2) are variably controlled according to the outdoor air temperature, such that the operation efficiency of the refrigerating chamber 14 may increase. In this case, the refrigerant recovery operation times (t1, t2) are not limited thereto, and can also be changed in various ways according to the capacity or design structure of the refrigerator 1 as necessary.

If the refrigerant recovery operation times (t1, t2) are set according to outdoor air temperature, the indoor air temperature sensor 100 may detect indoor air temperatures of the freezing chamber 12 and the refrigerating chamber 14, and may transmit the detected indoor air temperatures to the controller 130.

Therefore, the controller 130 may compare the indoor air temperatures (detected by the indoor air temperature sensors 100) of the freezing chamber 12 and the refrigerating chamber 14 with the setting temperatures, and may determine whether the start time of the compressor 20 is achieved (S404).

If it is determined in operation 404 that the start time of the compressor 20 is achieved, the controller 130 may start operation of the compressor 20 through the drive unit 150 (S406).

Subsequently, the controller 130 may perform a first refrigerant recovery operation to recover the refrigerant remaining in the freezing chamber evaporator 32 into the side of the condenser 22 at the start time of the compressor 20 (S408).

In this case, the controller 130 may count the refrigerant recovery operation time in which the refrigerant remaining in the freezing chamber evaporator 32 moves to the side of the condenser 22 through the first refrigerant recovery operation performed when the compressor 20 starts operation (S410), and may determine whether the first time (t1) has elapsed (S412).

If it is determined in operation 412 that the first time has elapsed, the controller 130 may switch on the flow passage switching valve 26 in the R direction (i.e., the refrigerating chamber direction) shown in FIG. 6 so as to cool the refrigerating chamber 14.

If the flow passage switching valve 26 is switched on in the R direction (i.e., the refrigerating chamber direction), the refrigerant may circulate in the order of compressor 20→condenser 22→hot pipe 24→flow passage switching valve 26→refrigerating chamber expansion unit 30→refrigerating chamber evaporator 34→compressor 20 in the refrigerating chamber operation mode, thereby performing the cooling operation of the refrigerating chamber 14 (S414).

After the indoor air temperature of the refrigerating chamber 14 reaches the setting temperature, the controller 130 may switch on the flow passage switching valve 26 in the F direction (i.e., the freezing chamber direction) shown in FIG. 6 so as to cool the freezing chamber 12.

If the flow passage switching valve 26 is switched on in the F direction (i.e., the freezing chamber direction), the refrigerant may circulate in the order of compressor 20→condenser 22→hot pipe 24→flow passage switching valve 26→freezing chamber expansion unit 28→freezing chamber evaporator 32→compressor 20 in the freezing chamber operation mode, thereby performing the cooling operation of the freezing chamber 12 (S416).

As described above, after the freezing chamber 12 and the refrigerating chamber 14 are independently cooled, the controller 130 may determine whether the compressor 20 is in an OFF condition (S418).

If it is determined in operation 418 that the compressor 20 is in the OFF condition, the controller 130 may perform a second refrigerant recovery operation just before the compressor 20 stops operation such that the refrigerant remaining in the freezing chamber evaporator 32 is recovered into the condenser 22 (S420).

In this case, the controller 130 may count the refrigerant recovery operation time in which the refrigerant remaining in the freezing chamber evaporator 32 is stored in the high-pressure part through the second refrigerant recovery operation performed just before the compressor 20 stops operation (S422), and may determine whether the second time (t2) has elapsed (S424).

If it is determined in operation 424 that the second time has elapsed, the controller 130 stops the compressor 20 through the drive unit 150 (S426), and finishes the parallel cycle.

In the meantime, although the embodiment of the present disclosure has exemplarily disclosed that outdoor air temperature of the peripheral part of the refrigerator 1 is detected before it is determined whether the start time of the compressor 20 is achieved, the scope or spirit of the present disclosure is not limited thereto, and the embodiment can also detect outdoor air temperature after determining whether the start time of the compressor 20 is achieved.

As is apparent from the above description, the refrigerator and the method for controlling the same according to the embodiments of the present disclosure can guarantee a sufficiently long refrigerant recovery operation time by performing the refrigerant recovery operation not only when the compressor starts operation but also before the compressor stops operation, resulting in implementation of the highest operation efficiency of a refrigerating chamber. In addition, the refrigerator can guarantee high reliability of the compressor by increasing the refrigerant recovery amount within a predetermined pressure range in which the compressor can operate, and can maintain an optimum refrigerant amount by variably controlling the refrigerant recovery operation time according to the outdoor air temperature, resulting in improvement of energy efficiency.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A refrigerator comprising:

a compressor;

a condenser configured to condense refrigerant compressed by the compressor;

a freezing chamber evaporator and a refrigerating chamber evaporator connected in parallel to each other at an outlet of the condenser;

a flow passage switching valve configured to switch a flow passage of the refrigerant in a manner that the refrigerant flows toward one of the freezing chamber evaporator and the refrigerating chamber evaporator;

a temperature sensor configured to detect an outdoor air temperature; and a controller configured to when an operation of the compressor is started at a first time and prior to expiration of a first time period, control the flow passage switching valve in a manner that a first refrigerant recovery operation from one of the freezing chamber evaporator and the refrigerating chamber evaporator is performed, and determine a second time at which the operation of the compressor is to be stopped and control the flow passage switching valve in a manner that a second refrigerant recovery operation from the one of the freezing chamber evaporator and the refrigerating chamber evaporator is performed during a second time period prior to the second time, wherein the controller variably controls the first time period of the first refrigerant recovery operation and the second time period of the second refrigerant recovery operation according to the detected outdoor air temperature.

2. The refrigerator according to claim 1, wherein the controller increases the first time period and the second time period in proportion to the increasing outdoor air temperature.

3. The refrigerator according to claim 1, further comprising:

a check valve arranged at an outlet of the freezing chamber evaporator, wherein the check valve prevents the refrigerant from flowing to the freezing chamber evaporator during the first refrigerant recovery operation and the second refrigerant recovery operation.

4. The refrigerator according to claim 3, wherein the flow passage switching valve is a 3-way valve, which is connected to a pipe of an outlet of the condenser and connected to pipes of inlets of the freezing chamber evaporator and the refrigerating chamber evaporator.

5. A refrigerator comprising:

a first storage chamber controlled at a first target temperature;

a second storage chamber, which is cooled independently from the first storage chamber and is spatially separated from the first storage chamber, and which is controlled at a second target temperature higher than the first target temperature;

a first evaporator installed in the first storage chamber;

a second evaporator installed in the second storage chamber;

a compressor connected to the first evaporator and the second evaporator so as to compress refrigerant;

a temperature sensor configured to detect outdoor air temperature; and a controller configured to:

when an operation of the compressor is started at a first time and prior to expiration of a first time period, perform a first refrigerant recovery operation in which refrigerant remaining in one of the first evaporator and the second evaporator is recovered, and determine a second time at which the operation of the compressor is to be stopped and perform a second refrigerant recovery operation in which refrigerant remaining in the one of the first evaporator and the second evaporator is recovered during a second time period prior to the second time, wherein the controller variably controls the first time period of the first refrigerant recovery operation and the second time period of the second refrigerant recovery operation according to the detected outdoor air temperature.

6. The refrigerator according to claim 5, further comprising:

a check valve arranged at one of outlets of the first evaporator and the second evaporator.

7. The refrigerator according to claim 6, further comprising:

a flow passage switching valve configured to switch a flow passage of the refrigerant in a manner that the refrigerant flows toward one of the first evaporator and the second evaporator; and wherein the first refrigerant recovery operation and the second refrigerant recovery operation move the refrigerant remaining in a low-pressure part toward a high-pressure part by operating the compressor on the condition that all directions of the flow passage switching valve are closed.

8. A method for controlling a refrigerator which includes a compressor and a freezing chamber evaporator and a refrigerating chamber evaporator connected in parallel to each other at an outlet of the compressor, the method comprising:

determining whether a start time of the compressor is achieved;

after the start time of the compressor is achieved, performing a first refrigerant recovery operation in which refrigerant remaining in the freezing chamber evaporator is recovered;

independently cooling a freezing chamber and a refrigerating chamber upon completion of the first refrigerant recovery operation;

determining whether a stop time of the compressor is detected while the freezing chamber and the refrigerating chamber are independently being cooled;

when the stop time of the compressor is detected, performing a second refrigerant recovery operation in which refrigerant remaining in the freezing chamber evaporator is recovered prior to the stop time;

stopping the compressor upon completion of the second refrigerant recovery operation;

detecting an outdoor air temperature; and changing an operation time of the first refrigerant recovery operation and an operation time of the second refrigerant recovery operation according to the detected outdoor air temperature.

9. The method according to claim 8, wherein the operation time of the first refrigerant recovery operation is identical to the operation time of the second refrigerant recovery operation.

10. The method according to claim 9, wherein the operation time of the first refrigerant recovery operation is different from the operation time of the second refrigerant recovery operation.

11. The method according to claim 8, wherein the first refrigerant recovery operation and the second refrigerant recovery operation operate the compressor on the condition that supply of the refrigerant flowing to the freezing chamber evaporator and the refrigerating chamber evaporator is prevented, such that the refrigerant remaining in the freezing chamber evaporator moves to a high-pressure part.

12. The method according to claim 8, wherein pressure of the compressor is continuously increased for a predetermined time ranging from a start time of any one of the first refrigerant recovery operation and the second refrigerant recovery operation to a start time of the other one.

13. The method according to claim 8, wherein the start time of the compressor is identical to a time point at which the compressor starts operation when indoor air temperatures of the freezing chamber and the refrigerating chamber are higher than respective target temperatures by a predetermined temperature or higher.

14. The method according to claim 8, wherein the stop time of the compressor indicates a time point at which the compressor stops operation after indoor air temperature of each of the freezing chamber and the refrigerating chamber reaches a target temperature.

* * * * *